US006638179B2

(12) United States Patent
Yoshida

(10) Patent No.: US 6,638,179 B2
(45) Date of Patent: Oct. 28, 2003

(54) GOLF CLUB

(75) Inventor: Hiroyuki Yoshida, Tsubame (JP)

(73) Assignee: K.K. Endo Seisakusho (JP)

( * ) Notice: Subject to any disclaimer, the term of this patent is extended or adjusted under 35 U.S.C. 154(b) by 65 days.

(21) Appl. No.: 09/965,701

(22) Filed: Sep. 26, 2001

(65) Prior Publication Data

US 2002/0039932 A1 Apr. 4, 2002

(30) Foreign Application Priority Data

Sep. 26, 2000 (JP) ..... 2000-292854

(51) Int. Cl.[7] ..... A63B 53/04
(52) U.S. Cl. ..... 473/324; 473/349
(58) Field of Search ..... 473/324, 131, 473/330, 331, 347, 348, 349, 350, 409, 290, 342

(56) References Cited

U.S. PATENT DOCUMENTS 5,207,427 A * 5/1993 Saeki
5,695,883 A * 12/1997 Harada
5,792,004 A * 8/1998 Nagamoto
6,171,989 B1 * 1/2001 Yoshida

FOREIGN PATENT DOCUMENTS

| | | |
|---|---|---|
| JP | 4-146771 A | 5/1992 |
| JP | 9-268380 A | 10/1997 |
| JP | 2001-29515 A | 2/2001 |

* cited by examiner

*Primary Examiner*—Sebastiano Passaniti
(74) *Attorney, Agent, or Firm*—Akerman Senterfitt

(57) ABSTRACT

A golf club which can give a golf player a soft feel of striking. A metallic head 1 has a face 3 whose surface is formed with a silver plating layer 8 of Hv 200 or below. Thus, the surface of the face 3 is protected from rust, and a softer feel of striking can be obtained when he strikes a ball, unlike conventional golf clubs with hard plating layer. As the surface for striking balls is comparatively soft, a period of time that a ball is contact with the face 3 is prolonged, thus making it easier for a player to give a spin to the ball. A black layer 9 is formed on the silver plated surface of the face 3, and thus less reflection of light is resulted at the time of addressing a ball, so that balls can be addressed easily.

8 Claims, 1 Drawing Sheet

GOLF CLUB

BACKGROUND OF THE INVENTION a) Field of the Invention

The present invention relates to a golf club.

b) Prior Art

Golf clubs which comprise a head and a shaft, are generally classified as one of three types: a wood, an iron, or a putter. Irons are classified by the loft angle of their head. Irons with a small loft angle (for example, from 20 to 30 degrees) are called "long irons", while irons with a large loft angle (for example, from 40 to 50 degrees) are called "short irons". Normally, irons are numbered in ascending order from longest to shortest, for example, Nos. 1, 2, 3, 4, 5, 6, 7, 8, 9, PW (pitching wedge) and SW (sand wedge).

In golf clubs, soft feel of string balls is preferred, and thus conventional golf clubs have used low-carbon steel or soft iron such as S20C as materials, of which the surface has been plated for protecting from corrosion. Such conventional plating has been comparatively hard, such as hard chromium (Vickers Hardness:Hv900), nickel boron plating (Hv800), and nickel plating (Hv450).

As golfers, particularly those who are in an advance course and professional golfers tend to prefer softer feel of striking balls, they are very sensitive to any change in the feel of striking, ball-spins, and controllability of balls, despite the plating layer being as thin as 20–30 $\mu$m. For this reason, such golfers have used golf clubs which are free from plating only in face or in the whole surface, in the case of short irons such as PW and SW. However, there would occur a problem that portions free from plating will naturally get rusty.

SUMMARY OF THE INVENTION

To eliminate the above problems, it is, therefore, a main object of the present invention to provide a golf club which can produce a softer feel of striking particularly requested by advanced players and/or professional players.

To attain the above objects, there is provided, in accordance with an aspect of the invention, a golf club, which includes a metallic head body with a face, said face having a surface in a front, wherein a plating layer of Hv 200 or below is formed on a surface which at least includes said surface of the face.

According to the structure, there can be provided a golf club which is provided with a soft face for striking a ball.

According to another aspect of the invention in accordance with the foregoing aspect, the said plating layer is a silver plating layer which is so soft and elastically deformable that a ball can be given sufficient spins because such a soft silver plating layer enable a ball to be in contact with the face for a longer period of time.

According to a further embodiment of the invention, there is provided a golf club according to the foregoing aspect, wherein said surface of the face is colored.

According to the structure, it is possible to provide a golf club in which reflection of light is prevented.

BRIEF DESCRIPTION OF THE DRAWINGS

Other objects, features and advantages of the invention will be apparent to those skilled in the art from the following description of the preferred embodiments of the invention, wherein reference is made to the accompanying drawings, of which.

DESCRIPTION OF PREFERRED EMBODIMENTS

Hereinafter will be described an embodiment of the invention with reference to the attached drawings.

Figure 1:
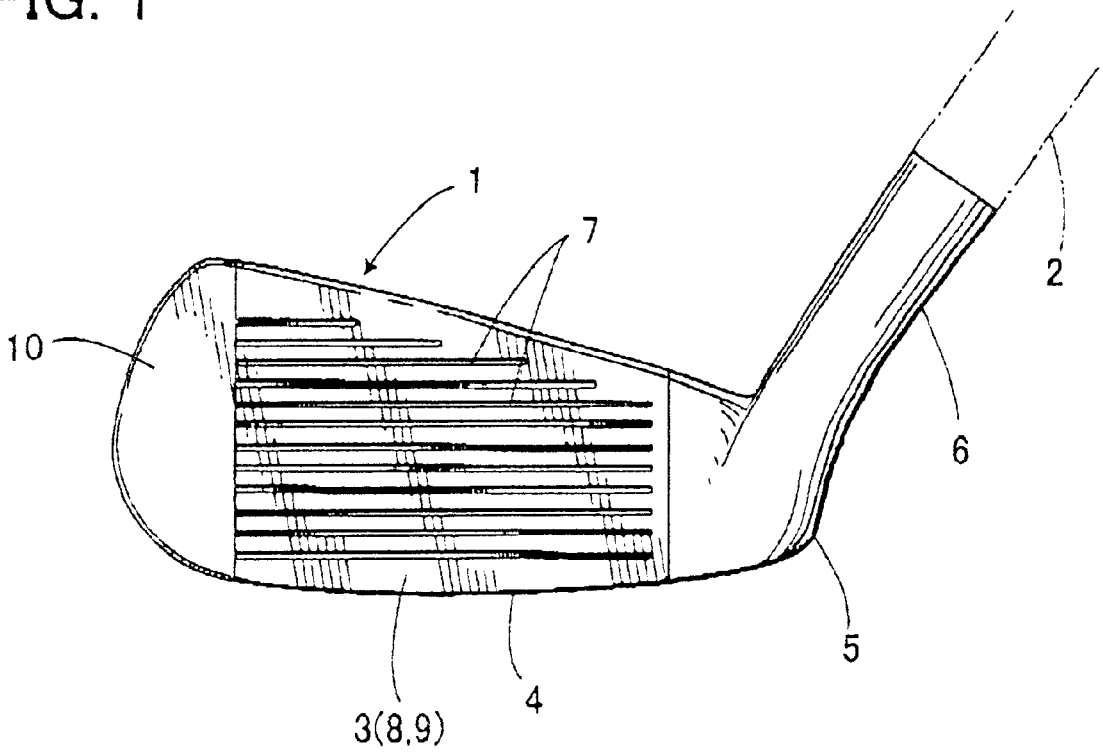
FIG. 1 is a front view showing a golf club according to an embodiment of the invention.
Figure 2:
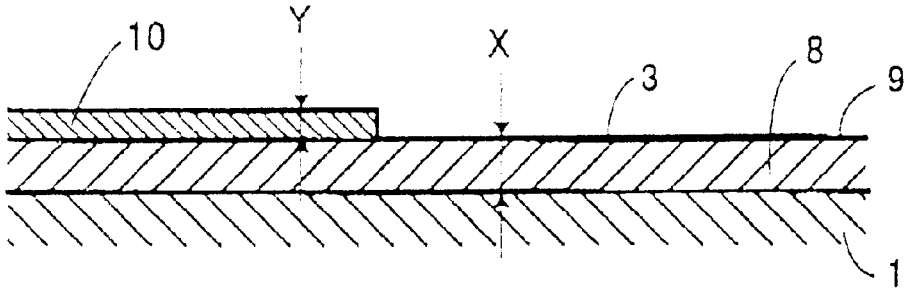
FIG. 2 is a section of a golf club according to the embodiment of the invention.

As shown in FIGS. 1 and 2, a golf club of the invention is of an iron type, constructed of a golf club head 1 and a shaft 2 provided above a first side thereof. The head 1 includes a face 3 formed in a front, a sole 4 in a bottom, a heel 5 formed in a lower portion of the said first side, said heel 5 being provided at the first side of said sole 4, and a hosel 6 formed above the heel 5 for connecting the shaft 2 thereto. In the meantime, reference numeral 7 in the drawings designates lateral grooves formed on the face 3, which are called score lines. The aforesaid face 3 is defined approximately between the right and left ends of the lateral grooves 7.

The metallic head 1 may be manufactured by suitable manufacturing methods. For example a round bar of S20C may be first processed by hot forging, and then may be machined and polished to a final product. Forming the head 1 by forging would serve to produce a softer feel of striking when a golfer strikes a ball.

The head 1 thus forged is then formed with a silver plating layer 8. The silver plating layer 8 is formed on the face 3, having a top surface thereof formed with a black layer 9. On the other hand, other portions than the face 3 also are formed with the silver plating layer 8 with their top surfaces formed with a hard chromium plating layer 10.

The aforesaid silver plating layer 8 is comparatively soft, having a Vickers Hardness: Hv 80–120, preferably about Hv 100, which is less than Hv 200, enabling the applying of a thick layer of which the thickness X is from 14 to 45 $\mu$m, preferably 30 $\mu$m for example, at relatively low costs.

The silver plating layer 8 is formed by the following steps:

The first step: alkali dip washing the head 1 formed by forging or the like;

the second step: water washing the same;

the third step: subjecting the same to electrolytic degreasing;

the fourth step: water washing the same;

the fifth step: water washing the same again;

the sixth step: neutralizing the same by 20% hydrochloric acid solution;

the seventh step: water washing the same;

the eighth step: subjecting the same to nickel strike plating;

the ninth step: water washing the same;

the tenth step: neutralizing the same by dipping in 20% sodium cyanide solution;

the eleventh step: water washing the same;

the twelfth step: subjecting the same to silver strike plating;

the thirteenth step: dipping the same in silver bright plating liquid;

the fourteenth step: water washing the same;

the fifteenth step: water washing the same again;

the sixteenth step: dipping the same in water cutting agent;

the seventeenth step: water washing the same;

the eighteenth step: water washing the same again;

the nineteenth step: hot water washing the same; and the twentieth step: drying the same.

Next, the head 1 subjected to the above steps is plated with hard chromium plating with only the face 3 being masked (not shown), thereby forming the hard chromium plating layer 10 on the silver plating layer 8 on an entire surface except the face 3 when the face 3 is unmasked. The thickness Y of the hard chromium plating layer 10 is 2.5 to 10 $\mu$m, preferably 5 $\mu$m.

Further, the black layer 9 formed on the silver plating layer 8 on the face 3 is formed by the following steps:

The first step: alkali electrolytic degreasing the head 1 with the silver plating layer 8 appearing on the face 3 while the hard chromium plating layer 10 appearing on the surface except the face 3;

the second step: water washing the same;

the third step: water washing the same again;

the fourth step: dipping the same in a potassium sulfide solution of about 80 degrees centigrade;

the fifth step: water washing the same;

the sixth step: hot water washing the same; and the seventh step: drying the same.

It should be noted that the black layer 9 formed through the dipping in the above-mentioned potassium sulfide solution is formed very thin on the surface of the silver plating layer 8, while the hard chromium layer 10 does not react with the potassium sulfide solution, and thus no discoloration occurs.

Accordingly, when a golfer strikes a ball (not shown), with the shaft 2 gripped with his hands, he can give the ball sufficient spins because the silver plating layer 8 is soft enough for the layer 8 to be elastically deformed, thereby extending a period of time in which the ball is in contact with the face 3.

As is apparent from the foregoing, according to the foregoing embodiment of the invention, the face 3 of the metallic head 1 is formed with the silver plating layer 8 of Hv 200 or below, so that the face 3 is not only protected from the rust, but a softer feel of striking can be obtained, which eventually contributes to extending a period of time in which the ball is in contact with the face 3, whereby ball spins can be given more easily.

Further, as the plating applied onto the face 3 is the silver plating layer 8, it can be carried out at comparatively low costs, and it is possible to thicken the face.

Furthermore, as the black layer 9 is formed on the silver plating layer 8 on the surface of the face 3, the dazzling reflection of light from the silver plating layer 8 can be prevented at the time of addressing balls, so that a golfer can address balls more easily.

In addition to the foregoing, the remaining surface of the head 1 except the face 3 is formed with the hard chromium plating layer 10, it can be protected from rust and damages such as scratches.

Incidentally the present invention should not be limited to the foregoing embodiments, but may be modified within the scope of the invention. For example, although the black layer 9 is formed on the silver plating layer 8 on the face 3 in the foregoing embodiment, colored alumina particles may be blasted to the silver plating layer 8 on the face 3 in order for the surface of the silver plating layer 8 to reflect less light due to the coloring.

What is claimed:

1. A golf club comprising:

a metallic head body with a face, wherein a plating layer of Hv 200 or below is formed on a surface of said head body which at least includes a surface of said face, and wherein the surface of said face is colored by a black layer which is formed by dipping said plated head in a potassium sulfide solution.

2. A golf club according to claim 1, wherein said plating is silver plating.

3. A golf club according to claim 2, wherein the surface of said head body except the surface of said face is formed with a hard chromium plating layer on said silver plating layer.

4. A golf club according to claim 2, wherein said silver plating layer has a Vickers Hardness of Hv 80 to 120, and a thickness of 15 to 45 $\mu$m.

5. A golf club comprising:

a metallic head body with a face, wherein a plating layer of Hv 200 or below is formed on a surface of said head body which at least includes a surface of said face, and wherein the surface of said face is colored by blasting colored alumina particles onto the surface of said face of said plated head.

6. A golf club according to claim 5, wherein said plating layer is silver.

7. A golf club according to claim 6, wherein the surface of said head body except the surface at said face is formed with a hard chromium plating layer on said silver plating layer.

8. A golf club according to claim 6, wherein said silver plating layer has a Vickers Hardness of Hv 80 to 120, and a thickness of 15 to 45 $\mu$m.

* * * * *

UNITED STATES PATENT AND TRADEMARK OFFICE

CERTIFICATE OF CORRECTION

PATENT NO. : 6,638,179 B2
DATED : October 28, 2003
INVENTOR(S) : Hiroyuki Yoshida It is certified that error appears in the above-identified patent and that said Letters Patent is hereby corrected as shown below:

Column 1,
Line 18, replace “string” with -- striking --

Signed and Sealed this

Fourth Day of January, 2005

JON W. DUDAS
*Director of the United States Patent and Trademark Office*